US007101830B2

(12) United States Patent
Owen et al.

(10) Patent No.: US 7,101,830 B2
(45) Date of Patent: Sep. 5, 2006

(54) GAS ENGINE LUBRICATING OIL COMPOSITION

(75) Inventors: Yolanda Owen, Wantage (GB); Laurent Chambard, Faringdon (GB)

(73) Assignee: Infineum International Ltd., (GB)

( * ) Notice: Subject to any disclaimer, the term of this patent is extended or adjusted under 35 U.S.C. 154(b) by 102 days.

(21) Appl. No.: 10/378,367

(22) Filed: Mar. 3, 2003

(65) Prior Publication Data

US 2003/0186821 A1 Oct. 2, 2003

(30) Foreign Application Priority Data

Mar. 12, 2002 (EP) ..... 02251740

(51) Int. Cl.
*C10M 159/20* (2006.01)

(52) U.S. Cl. ..... 508/185; 508/460

(58) Field of Classification Search ..... 508/185
See application file for complete search history.

(56) References Cited

U.S. PATENT DOCUMENTS

| | | | | | |
|---|---|---|---|---|---|
| 5,698,499 | A * | 12/1997 | Baranski et al. | ..... | 508/198 |
| 5,965,495 | A * | 10/1999 | Goto et al. | ..... | 508/192 |
| 6,001,780 | A * | 12/1999 | Ho et al. | ..... | 508/192 |
| 6,004,910 | A * | 12/1999 | Bloch et al. | ..... | 508/294 |
| 6,147,035 | A * | 11/2000 | Sougawa et al. | ..... | 508/192 |
| 6,645,922 | B1 * | 11/2003 | Dunn et al. | ..... | 508/398 |
| 6,730,638 | B1 * | 5/2004 | Farng et al. | ..... | 508/194 |
| 6,777,378 | B1 * | 8/2004 | Abraham et al. | ..... | 508/185 |
| 6,783,561 | B1 * | 8/2004 | Erdemir | ..... | 44/314 |
| 6,787,509 | B1 * | 9/2004 | Chambard et al. | ..... | 508/460 |

FOREIGN PATENT DOCUMENTS

| | | |
|---|---|---|
| EP | 0 725 129 A2 | 8/1996 |
| EP | 0 725 129 A3 | 1/1997 |
| EP | 0 860 495 A2 | 8/1998 |
| EP | 0 860 495 A3 | 4/1999 |
| EP | 1 104 800 A2 | 6/2001 |
| EP | 1 104 800 A3 | 6/2001 |
| WO | WO00/70001 | 11/2000 |

OTHER PUBLICATIONS

"Calcium Borate Overbased Metallic Detergent", K. Inoue, Lubrication Engineering, Society of Tribologsts and Lubrication Engineers, Park Ridge, US, vol. 49, No. 4, 1992, pp. 263-268.

* cited by examiner

*Primary Examiner*—Ellen M. McAvoy

(57) ABSTRACT

A gas engine lubricating oil composition having a boron content of more than 95 ppm, the gas engine lubricating oil composition comprising: a major amount of a lubricating oil having a viscosity index of 80 to 120, and including at least 90 mass percent of saturates and 0.03 mass percent or less of sulphur; and at least one metal detergent.

The gas engine lubricating oil composition exhibits improved oxidation and reduced deposit formation.

9 Claims, No Drawings

GAS ENGINE LUBRICATING OIL COMPOSITION

This invention concerns an improved gas engine lubricating oil composition; in particular, a gas engine lubricating oil composition exhibiting improved resistance to oxidation and reduced deposit formation.

Gas engines, which are also called gas-fuelled or gas-fired engines, are used to drive pumping stations of natural-gas pipelines, blowers and generators in, for example, purification plants and on gas tankers. Gas engines may be two- or four-stroke, spark-ignited or compression-ignited. Gas Otto engines ignite a mixture of gas and air using spark plugs. Gas diesel engines use a continuous injection of a small amount, such as, for example, 5–10%, of diesel fuel.

Gas engines operate at high temperatures such as greater than 200° C. in a piston environment. These high temperatures cause oxidation of the gas engine lubricating oil composition, which produces undesirable acids. These acids cause corrosion of the gas engine, in particular, corrosion of bearings in crankshaft journals and crankpins.

It is important that a gas engine lubricating oil composition does not produce piston deposits or in the case of two-stroke engines cause plugging of exhaust slots. The gas engine lubricating oil composition should therefore preferably have either a low ash content such as, for example, below 0.6 wt % ash, or a medium ash content such as, for example, between 0.6 and 1.5 wt % ash, as determined by ASTM D874. If a lubricating oil composition has an ash level that is too low, it will shorten the working life of valves and cylinder heads. If, on the other hand, a lubricating oil composition has an ash level that is too high, excessive deposits will be produced in upper combustion chambers and upper piston areas.

Gas engine lubricating oil compositions usually include a major amount of base oil of lubricating viscosity and the following additives: up to 10 wt % of detergents, 0.5 to 8 wt % of dispersants, 0.05 to 2.0 wt % of antioxidants, 0.01 to 0.2 wt % of metal deactivators, 0.05 to 1.5 wt % of anti-wear additives, 0.05 to 0.6 wt % of pour point depressants, 0.001 to 0.2 wt % of anti-foam agents and 0.1 to 3.0 wt % of viscosity index improvers.

The aim of this invention is to provide an improved gas engine lubricating oil composition. A further aim of this invention is to provide a gas engine lubricating oil composition that exhibits improved resistance to oxidation and reduced deposit formation.

In accordance with the present invention there is provided a gas engine lubricating oil composition having a boron content of at least 95 ppm, the composition comprising:

a) a major amount of a lubricating oil having a viscosity index of 80 to 120, and including at least 90 mass percent of saturates and 0.03 mass percent or less of sulphur, and b) at least one metal detergent.

The boron content in the gas engine lubricating oil composition preferably ranges from 95 to 400 ppm, more preferably from 100 to 400 ppm, more preferably from 100 to 200 ppm, and most preferably from 105 to 170 ppm. The boron may be supplied by a borated metal detergent or by an additional borated compound such as, for example, a borated succinimide dispersant.

In accordance with the present invention there is also provided a method of lubricating a gas engine, the method comprising the step of operating the gas engine while lubricating it with the gas engine lubricating oil composition defined above.

In accordance with the present invention there is also provided a gas engine lubricating oil concentrate having a boron content of at least 800 ppm, preferably 800 to 8,000 ppm, more preferably 830 to 4,000 ppm, and most preferably 875 to 3,400 ppm, the concentrate including at least one metal detergent.

In accordance with the present invention there is also provided use of the gas engine lubricating oil composition as a lubricant in a gas engine to improve resistance to oxidation and to reduce deposit formation.

The inventors have surprisingly found that the gas engine lubricating oil composition defined above exhibits improved oxidation and reduced deposit formation.

Lubricating Oil Composition

The lubricating oil composition preferably has a TBN in the range of from 4 to 20, more preferably from 5 to 20, even more preferably from 5 to 15.

Lubricating Oil

The lubricating oil needs to have a viscosity index of 80 to 120. The viscosity index can be determined using ASTM D 2270.

The lubricating oil needs to include at least 90 mass percent of saturates. The amount of saturates can be determined using ASTM D 2007.

The lubricating oil must include no more than 0.03 mass percent of sulphur. The amount of sulphur can be determined using ASTMs D 2622, D 4294, D 4927 or D3120.

The lubricating oil generally comprises greater than 60, typically greater than 70, more preferably greater than 80 wt % of the lubricating oil composition.

The lubricating oil can be any Group II base oil.

Hydrocracked oils, where the refining process further breaks down the middle and heavy distillate fractions in the presence of hydrogen at high temperatures and moderate pressures, are also suitable. Hydrocracked oils typically have a viscosity index typically in the range of from 100 to 110, for example from 105 to 108.

The oil may include 'brightstock' which refers to base oils that are solvent-extracted, de-asphalted products from vacuum residuum generally having a kinematic viscosity at 100° C. of from 28 to 36 $mm^2s^{-1}$ and are typically used in a proportion of less than 30, preferably less than 20, more preferably less than 15, most preferably less than 10, such as less than 5, wt %, based on the weight of the composition.

Metal Detergent

A detergent is an additive that reduces formation of piston deposits, for example high-temperature varnish and lacquer deposits, in engines; it has acid-neutralising properties and is capable of keeping finely divided solids in suspension. It is based on metal "soaps", that is metal salts of acidic organic compounds, sometimes referred to as surfactants.

The detergent comprises a polar head with a long hydrophobic tail. The polar head comprises a metal salt of a surfactant. Large amounts of a metal base are included by reacting an excess of a metal compound, such as an oxide or hydroxide, with an acidic gas such as carbon dioxide to give an overbased detergent which comprises neutralised detergent as the outer layer of a metal base (e.g. carbonate) micelle.

The metal may be an alkali or alkaline earth metal such as, for example, sodium, potassium, lithium, calcium, barium and magnesium. Calcium is preferred.

The surfactant may be a salicylate, a sulfonate, a carboxylate, a phenate, a thiophosphate or a naphthenate. Metal salicylate is the preferred metal salt.

The detergent may be a complex/hybrid detergent prepared from a mixture of more than one metal surfactant, such as a calcium alkyl phenate and a calcium alkyl salicylate. Such a complex detergent is a hybrid material in which the surfactant groups, for example phenate and salicylate, are incorporated during the overbasing process. Examples of complex detergents are described in the art (see, for example, WO 97/46643, WO 97/46644, WO 97/46645, WO 97/46646 and WO 97/46647).

Surfactants for the surfactant system of the metal detergents contain at least one hydrocarbyl group, for example, as a substituent on an aromatic ring. The term "hydrocarbyl" as used herein means that the group concerned is primarily composed of hydrogen and carbon atoms and is bonded to the remainder of the molecule via a carbon atom, but does not exclude the presence of other atoms or groups in a proportion insufficient to detract from the substantially hydrocarbon characteristics of the group. Advantageously, hydrocarbyl groups in surfactants for use in accordance with the invention are aliphatic groups, preferably alkyl or alkylene groups, especially alkyl groups, which may be linear or branched. The total number of carbon atoms in the surfactants should be at least sufficient to impact the desired oil-solubility. Advantageously the alkyl groups include from 5 to 100, preferably from 9 to 30, more preferably 14 to 20, carbon atoms. Where there is more than one alkyl group, the average number of carbon atoms in all of the alkyl groups is preferably at least 9 to ensure adequate oil-solubility.

The detergents may be non-sulfurized or sulfurized, and may be chemically modified and/or contain additional substitutents. Suitable sulfurizing processes are well known to those skilled in the art.

The detergents may be borated, using borating processes well known those skilled in the art.

The detergents preferably have a TBN of 20 to 400, preferably 40 to 300, more preferably 40 to 280, even more preferably 40 to 150, even more preferably 50 to 140, and most preferably 60 to 130.

The detergents may be used in a proportion in the range of 0.5 to 30, preferably 2 to 20, or more preferably 2 to 15, wt % based on the weight of the lubricating oil composition.

Dispersant

At least one dispersant may be present in the gas engine lubricating oil composition. A dispersant is an additive for a lubricating composition whose primary function is to hold solid and liquid contaminants in suspension, thereby passivating them and reducing engine deposits at the same time as reducing sludge depositions. Thus, for example, a dispersant maintains in suspension oil-insoluble substances that result from oxidation during use of the lubricating oil, thus preventing sludge flocculation and precipitation or deposition on metal parts of the engine.

A noteworthy class of dispersants are "ashless", meaning a non-metallic organic material that forms substantially no ash on combustion, in contrast to metal-containing, hence ash-forming, materials. Ashless dispersants comprise a long chain hydrocarbon with a polar head, the polarity being derived from inclusion of, e.g. an O, P or N atom. The hydrocarbon is an oleophilic group that confers oil-solubility, having for example 40 to 500 carbon atoms. Thus, ashless dispersants may comprise an oil-soluble polymeric hydrocarbon backbone having functional groups that are capable of associating with particles to be dispersed.

Examples of ashless dispersants are succinimides, eg polyisobutene succinic anhydride: polyamine condensation products which may be borated or unborated.

The dispersant may be present in an amount ranging from 0.5 to 8.0 wt %, preferably from 0.5 to 4.0 wt %, based on the weight of the lubricating oil composition.

Other Additives

Antiwear additives may be present in the gas engine lubricating oil composition. The antiwear additives may be metallic or non-metallic, preferably the former.

Dihydrocarbyl dithiophosphate metal salts are examples of anti-wear additives that may be used in the present invention. The metal in the dihydrocarbyl dithiophosphate metal salts may be an alkali or alkaline earth metal, or aluminium, lead, tin, molybdenum, manganese, nickel or copper. Zinc salts are preferred, preferably in the range of 0.1 to 1.5, preferably 0.5 to 1.3, wt %, based upon the total weight of the gas engine lubricating oil composition. They may be prepared in accordance with known techniques by firstly forming a dihydrocarbyl dithiophosphoric acid (DDPA), usually by reaction of one or more alcohols or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared comprising both hydrocarbyl groups that are entirely secondary and hydrocarbyl groups that are entirely primary. To make the zinc salt, any basic or neutral zinc compound may be used but the oxides, hydroxides and carbonates are most generally employed.

Commercial additives frequently contain an excess of zinc due to use of an excess of the basic zinc compound in the neutralisation reaction.

The preferred zinc dihydrocarbyl dithiophosphates are oil-soluble salts of dihydrocarbyl dithiophosphoric acids and may be represented by the following formula:

$$[(RO)(R^1O)P(S)S]_2Zn$$

where R and $R^1$ may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and $R^1$ groups are alkyl groups of 2 to 8 carbon atoms. Thus, the radicals may, for example, be ethyl, n-propyl, I-propyl, n-butyl, I-butyl, sec-butyl, amyl, n-hexyl, I-hexyl, n-octyl, decyl, dodecyl, octadecyl, 2-ethylehexyl, phenyl, butylphenyl, cyclohexyl, methylcyclopentyl, propenyl, butenyl. In order to obtain oil-solubility, the total number of carbon atoms (i.e. in R and $R^1$) in the dithiophoshoric acid will generally be 5 or greater. The zinc dihydrocarbyl dithiophosphate can therefore comprise zinc dialkyl dithiophosphates.

Antioxidants may also be added to the gas engine lubricating oil composition. These may be aminic or phenolic. Examples of aminic include secondary aromatic amines such as diarylamines, for example diphenylamines wherein each phenyl group is alkyl-substituted with an alkyl group having 4 to 9 carbon atoms. Examples of phenolics include hindered phenols, including mono-phenols and bis-phenols. The anti-oxidant may be present in an amount of up to 3 wt % based on the weight of the lubricating oil composition.

One or more of the following additives may also be present in the gas engine lubricating oil composition: pour point depressants such as poly(meth)acrylates or alkyl aromatic polymers; anti-foaming agents such as silicone anti-foaming agents; viscosity index improvers such as olefin copolymers; dyes; metal deactivators such as aryl thiazines, triazoles or alkyl substituted dimercapto thiadiazoles; and demulsifiers.

It may be desirable to prepare an additive package or concentrate of the gas engine lubricating oil composition. The additive package may be added simultaneously to the base oil to form the gas engine lubricating oil composition. Dissolution of the additive package into the lubricating oil may be facilitated by solvents and by mixing accompanied with mild heating. The additive package will typically be formulated to contain the detergent in proper amounts to provide the desired concentration, and/or to carry out the intended function in the final formulation when the additive package is combined with a predetermined amount of base lubricant. The additive package may contain active ingredients in an amount, based on the additive package, of, for example, from 2.5 to 90, preferably from 5 to 75, most preferably from 8 to 60, wt % of additives in the appropriate proportions, the remainder being base oil.

The final formulations may typically contain about 5 to 40 wt %, preferably 5 to 12 wt %, of the additive package, the remainder being base oil.

EXAMPLES

The present invention is illustrated by, but in no way limited to, the following examples.

Examples

Gas engine lubricating oil compositions identified in Table 1 were prepared by heating the components together at 60° C. for 30 minutes while stirring.

TABLE 1

| | Example 1 | Example 2 | Comparative Example 3 | Comparative Example 4 |
|---|---|---|---|---|
| Detergent, 64 BN Calcium Salicylate | 5.20 | 5.20 | 5.20 | 5.20 |
| Anti-wear, ZDDP | 0.31 | 0.31 | 0.31 | 0.31 |
| Anti-oxidant, alkylated diphenylamine | 1.35 | 1.35 | 1.35 | 1.35 |
| Dispersant, unborated PIBSA-PAM | | | 3.00 | 3.00 |
| Borated Dispersant, borated PIBSA-PAM | 3.00 | 3.00 | | |
| Anti-foamant, polydimethyl siloxane | 0.10 | 0.10 | 0.10 | 0.10 |
| Anti-rust, benzotriazole | 0.10 | 0.10 | 0.10 | 0.10 |
| Group I base oil, APE 150, available from ExxonMobil | 0.14 | 0.14 | 0.14 | 0.14 |
| Group I base oil, APE 600, available from ExxonMobil | | | 89.80 | |
| Group II base oil, Star 12, available from Motiva | 89.80 | | | 89.80 |
| Group II base oil, RLOP, available from Chevron | | 89.80 | | |
| BN | 6.5 | 6.5 | 6.5 | 6.1 |
| Kinematic Viscosity, 100° C. | 13.35 | 13.33 | 13.88 | 14.11 |
| Ash (calculated, w%) | 0.48 | 0.48 | 0.45 | 0.45 |
| Boron, ppm | 105 | 105 | none | none |

PIBSA-PAM: polyisobutenyl succinic anhydride-polyamine reaction product.
The base numbers (BN) were determined using ASTM 2896-98; and the ash contents were determined using ASTM D 874-00.

The gas engine lubricating oil compositions were subjected to the following tests:

Panel Coker Test; and

IR oxidation at EOT, after having been oxidised for 216 hours at 170° C. following the GFC T-021-A-90 testing procedure.

The Panel Coker Test

This test involves splashing a gas engine lubricating oil composition on to a heated test panel to see if the oil degrades and leaves any deposits that might affect engine performance. The test uses a panel coker tester (model PK-S) supplied by Yoshida Kagaku Kikai Co, Osaka, Japan. The test starts by heating the gas engine lubricating oil composition to a temperature of 100° C. through an oil bath. A test panel made of aluminium alloy, which has been cleaned using acetone and heptane and weighed, is placed above the gas engine lubricating oil composition and heated to 320° C. using an electric heating element. When both temperatures have stabilised, a splasher splashes the gas engine lubricating oil composition on to the heated test panel in a discontinuous mode: the splasher splashes the oil for 15 seconds and then stops for 45 seconds. The discontinuous splashing takes place over 1 hour, after which the test is stopped, everything is allowed to cool down, and then the aluminium test panel is weighed and rated visually. The difference in weight of the aluminium test panel before and after the test, expressed in mg, is the weight of deposits. The visual rating is made from 0 to 10, with 0 being for a completely black panel and 10 being for a completely clean panel.

The results are shown below in Table 2:

TABLE 2

| | Example 1 | Example 2 | Comparative Example 3 | Comparative Example 4 |
|---|---|---|---|---|
| Deposits (mg), Panel Coker Test | 13.7 | 12.7 | 20.4 | 20.4 |
| IR Oxidation at EOT | 26.3 | 16.2 | 47.5 | 33.0 |

The results show that the gas engine lubricating oil compositions falling within the present invention exhibit reduced deposits and improved oxidation results over the comparative compositions.

Comparative Examples 5 and 6 were also prepared and compared to Examples 1 and 2. Comparative Examples 5 and 6 both included a calcium salicylate having a TBN of 168 rather than a calcium salicylate having a TBN of 64.

TABLE 3

| | Example 1 | Example 2 | Comparative Example 5 | Comparative Example 6 |
|---|---|---|---|---|
| Detergent, 64 BN Calcium Salicylate | 5.20 | 5.20 | | |
| Detergent, 168 BN Calcium Salicylate | | | 1.98 | 5.20 |
| Anti-wear, ZDDP | 0.31 | 0.31 | 0.31 | 0.31 |
| Anti-oxidant, alkylated diphenylamine | 1.35 | 1.35 | 1.35 | 1.35 |
| Borated Dispersant, borated PIBSA-PAM | 3.00 | 3.00 | 3.00 | 3.00 |
| Anti-foamant, polydimethyl siloxane | 0.10 | 0.10 | 0.10 | 0.10 |
| Anti-rust, benzotriazole | 0.10 | 0.10 | 0.10 | 0.10 |
| Group I base oil, APE 150, available from ExxonMobil | 0.14 | 0.14 | 0.14 | 0.14 |
| Group II base oil, Star 12, available from Motiva | 89.80 | | 93.03 | 89.80 |
| Group II base oil, RLOP, available from Chevron | | 89.80 | | |
| BN | 6.5 | 6.5 | 5.9 | 11.1 |
| Kinematic Viscosity, 100° C. | 13.35 | 13.33 | 13.26 | 13.38 |
| Ash (calculated, 4%) | 0.48 | 0.48 | 0.48 | 1.11 |
| Boron, ppm | 105 | 105 | 105 | 105 |

Table 4 below shows that Comparative Examples 5 and 6 produced more deposits than Examples 1 and 2.

TABLE 4

| | Example 1 | Example 2 | Comparative Example 5 | Comparative Example 6 |
|---|---|---|---|---|
| Deposits (mg), Panel Coker Test | 13.7 | 12.7 | 48.9 | 127.2 |

What is claimed is:

1. A gas engine lubricating oil composition having a boron content of more than 95 ppm, the gas engine lubricating oil composition comprising:

a) a major amount of a lubricating oil having a viscosity index of 80 to 120, and including at least 90 mass percent of saturates and 0.03 mass percent or less of sulphur; and b) detergent, consisting essentially of calcium salicylate detergent having a TBN in the range of 40 to less than 150.

2. The composition as claimed in claim 1, wherein the boron content is from 95 to 400 ppm.

3. The composition claimed in claim 1, wherein the boron is provided by a borated metal detergent, a borated dispersant, or a combination thereof.

4. A method of lubricating a gas engine, the method comprising the step of operating the gas engine while lubricating it with the gas engine lubricating oil composition claimed in claim 1.

5. A method of improving resistance to oxidation and reducing deposit formation in a gas engine, which method comprises lubricating said gas engine with a lubricating oil composition as claimed in claim 1.

6. The composition as claimed in claim 1, wherein the metal detergent has a TBN in the range of 50 to 140.

7. The composition as claimed in claim 6, wherein the metal detergent has a TBN in the range of 60 to 130.

8. The composition as claimed in claim 1, which has a TBN in the range of 5 to 15.

9. The composition as claimed in claim 8, which has a TBN in the range of greater than 5.9 to less than 11.1.

* * * * *